US012606409B1

(12) United States Patent
Hoover

(10) Patent No.: US 12,606,409 B1
(45) Date of Patent: Apr. 21, 2026

(54) CANISTER-YARN TENSIONING ASSEMBLY INCORPORATING A PIVOTED YARN TENSIONER

(71) Applicant: American Linc, LLC, Gastonia, NC (US)

(72) Inventor: Donald Lynn Hoover, Cramerton, NC (US)

(73) Assignee: A.B. Carter, Inc., Gastonia, NC (US)

( * ) Notice: Subject to any disclaimer, the term of this patent is extended or adjusted under 35 U.S.C. 154(b) by 419 days.

(21) Appl. No.: 18/135,971

(22) Filed: Apr. 18, 2023

Related U.S. Application Data

(63) Continuation-in-part of application No. 18/021,588, filed as application No. PCT/US2021/047725 on Aug. 26, 2021.

(60) Provisional application No. 63/129,904, filed on Dec. 23, 2020.

(51) Int. Cl.

| | |
|---|---|
| ***B65H 59/06*** | (2006.01) |
| ***B65H 49/08*** | (2006.01) |
| ***B65H 57/06*** | (2006.01) |
| ***B65H 67/06*** | (2006.01) |

(52) U.S. Cl.
CPC ..... *B65H 59/06* (2013.01); *B65H 49/08* (2013.01); *B65H 57/06* (2013.01); *B65H 67/06* (2013.01); *B65H 2701/31* (2013.01)

(58) Field of Classification Search
CPC ..... B65H 49/08; B65H 67/02; B65H 59/06; B65H 67/04; D01H 9/008
See application file for complete search history.

(56) References Cited

U.S. PATENT DOCUMENTS

| | | | | | |
|---|---|---|---|---|---|
| 285,727 | A * | 9/1883 | Boyden | B65H 49/08 | 242/153 |
| 290,658 | A * | 12/1883 | Appleby | B65H 49/08 | 242/137.1 |
| 667,197 | A * | 2/1901 | Dennis | B65H 49/08 | 242/153 |
| 681,140 | A * | 8/1901 | Rand | B65H 49/08 | 242/156 |

(Continued)

FOREIGN PATENT DOCUMENTS

| | | | | |
|---|---|---|---|---|
| CN | 111942961 | A * | 11/2020 | B65H 49/08 |
| GB | 1581631 | A * | 12/1980 | B65H 54/702 |

(Continued)

*Primary Examiner* — Victoria P Augustine
*Assistant Examiner* — Katelynne R Burrell
(74) *Attorney, Agent, or Firm* — Schwartz Law Firm, P.C.

(57) ABSTRACT

A canister-yarn tensioning assembly is adapted for controlling tension in a running yarn drawn from a yarn supply package located within an open-top canister. A cylindrical adapter configured to reside at a mouth of the open-top canister. A yarn tensioner is attached by a hinge assembly at a peripheral flange of the adapter, and is configured for multiplanar movement between an operative position within the package transfer space and a package-replacement position outside of the package transfer space. Upon depleting the yarn supply package, the yarn tensioner is pivoted in a first plane at the hinge assembly to lift away from the package transfer space and then swivelled in a second plane at the hinge assembly to locate adjacent an outside wall of the canister.

9 Claims, 17 Drawing Sheets

(56) References Cited

U.S. PATENT DOCUMENTS 745,833 A * 12/1903 Hanson ..... B65H 49/08 242/137.1
750,574 A * 1/1904 Bicket ..... B65H 49/08 242/150 R
1,295,717 A * 2/1919 Erickson ..... B65H 49/08 242/148
3,316,703 A 5/1967 McKelvie
3,382,543 A * 5/1968 Roberts ..... B65H 67/0428 19/159 A
3,830,051 A * 8/1974 Veltges ..... B65H 59/22 57/279
3,863,433 A 2/1975 Murray
3,868,069 A * 2/1975 Schulz ..... B65H 59/06 242/593
3,892,065 A 7/1975 Kanai
3,958,404 A 5/1976 Kanai
4,423,590 A 1/1984 Tsukamoto
4,605,182 A 8/1986 Zollinger
5,806,780 A * 9/1998 Schneider ..... B21C 47/20 242/128
7,530,457 B2 * 5/2009 Tsang ..... A45C 13/005 220/817
9,868,610 B2 * 1/2018 Weissbrod ..... B23K 9/1333
12,240,034 B2 * 3/2025 Morton ..... B21F 1/02
2003/0209001 A1 11/2003 Schacht
2005/0011984 A1 1/2005 D'Agnolo
2007/0095687 A1 * 5/2007 Tsang ..... A45C 13/005 206/320
2014/0097287 A1 * 4/2014 Weissbrod ..... B65H 49/12 242/551
2016/0355368 A1 * 12/2016 Weissbrod ..... B65H 49/12
2017/0130367 A1 5/2017 Duralti et al.
2021/0163254 A1 * 6/2021 Hoover ..... B65H 59/06

FOREIGN PATENT DOCUMENTS

WO WO-2005078172 A1 * 8/2005 ..... D01D 10/049
WO 2019246614 12/2019

* cited by examiner

CANISTER-YARN TENSIONING ASSEMBLY INCORPORATING A PIVOTED YARN TENSIONER

TECHNICAL FIELD AND BACKGROUND

The present disclosure relates broadly and generally to the textile industry, and more particularly to a canister-yarn tensioning assembly incorporating a pivoted yarn tensioner. In one exemplary embodiment, the tensioning device of the present disclosure is utilized in a direct-cabling textile machine. In other applications, various components and features of the present disclosure may be used in combination with any other tensioning device and in any other textile machine.

SUMMARY OF EXEMPLARY EMBODIMENTS

Various exemplary embodiments of the present disclosure are described below. Use of the term "exemplary" means illustrative or by way of example only, and any reference herein to "the invention" is not intended to restrict or limit the invention to exact features or steps of any one or more of the exemplary embodiments disclosed in the present specification. References to "exemplary embodiment," "one embodiment," "an embodiment," "various embodiments," and the like, may indicate that the embodiment(s) of the invention so described may include a particular feature, structure, or characteristic, but not every embodiment necessarily includes the particular feature, structure, or characteristic. Further, repeated use of the phrase "in one embodiment," or "in an exemplary embodiment," do not necessarily refer to the same embodiment, although they may.

It is also noted that terms like "preferably", "commonly", and "typically" are not utilized herein to limit the scope of the invention or to imply that certain features are critical, essential, or even important to the structure or function of the invention. Rather, these terms are merely intended to highlight alternative or additional features that may or may not be utilized in a particular embodiment of the present invention.

According to one exemplary embodiment, the present disclosure comprises a canister-yarn tensioning assembly adapted for controlling (or adjusting) tension in a running yarn drawn from a yarn supply package located within an open-top canister. The canister-yarn tensioning assembly includes a cylindrical adapter configured to reside at a mouth of the open-top canister. The adapter defines an unobstructed package transfer space sufficient to allow the yarn supply package to be manually lowered through the adapter and into the canister. A pivoted support arm is carried by the adapter, and configured to pivot at a connection point located on a peripheral flange of the adapter. One or more yarn tensioners are carried by the pivoted support arm, and are movable between an operative position within the package transfer space and an inoperative package-replacement position outside of the package transfer space.

In the operative position, the yarn tensioner frictionally engages the running yarn drawn from the supply package during operation of the textile machine. The yarn tensioner receives running yarn pulled from the supply package at an unwinding tension, and adjusts the unwinding tension such that the yarn exits the tensioner at an adjusted downstream delivery tension.

Upon depleting the yarn supply package, the support arm is pivoted at the connection point to move the yarn tensioner from the operative position to the package-replacement position such that a fresh yarn supply package can be freely lowered through the package transfer space and into the canister. After inserting the fresh yarn supply package into the canister, the support arm is pivoted at the connection point to move the yarn tensioner back into the operative position-receiving running yarn pulled from the fresh package.

According to another exemplary embodiment, the pivoted support arm is mounted on a generally semi-circular horizontal flex cover. The flex cover is attached to the adapter at the connection point.

According to another exemplary embodiment, a horizontal reinforcement plate is located between the pivoted support arm and the flex cover.

According to another exemplary embodiment, the flex cover is fabricated of a thin flexible stainless steel.

According to another exemplary embodiment, the flex cover has a downwardly angled lip formed along a diameter line of the flex cover and configured to extend across the package transfer space when the yarn tensioner resides in the operative position.

According to another exemplary embodiment, the flex cover has an arcuate outside edge configured to align with the peripheral flange of the adapter when the yarn tensioner resides in the operative position.

According to another exemplary embodiment, the support arm angles inwardly from the arcuate edge of the flex cover towards the diameter line of the flex cover.

According to another exemplary embodiment, the yarn tensioner comprises at least one of a pre-tensioner and an adjustable main tensioner.

According to another exemplary embodiment, a tensioner bracket is attached to the support arm and comprises spaced apart first and second yarn guides located at upstream and downstream sides of the yarn tensioner.

According to another exemplary embodiment, the adapter is configured to nest inside the canister and includes a plurality of spaced apart (e.g, equally spaced) outwardly projecting support pins for holding the adapter at the mouth of the canister.

In another exemplary embodiment, the present disclosure comprises a canister assembly for use in a direct-cabling textile machine. The canister assembly includes an open-top yarn canister configured for holding a yarn supply package, and for receiving the yarn supply package through a package transfer space. A pivoted support arm is configured to pivot at a connection point located adjacent an annular peripheral edge of the canister. One or more yarn tensioners are carried by the pivoted support arm, and are movable between an operative position within the package transfer space and an inoperative package-replacement position outside of the package transfer space. As previously described, in the operative position the yarn tensioner frictionally engages the running yarn drawn from the supply package during operation of the textile machine. Upon depleting the yarn supply package, the support arm is pivoted at the connection point to move the yarn tensioner from the operative position to the package-replacement position such that a fresh yarn supply package can be freely lowered through the package transfer space and into the canister. After inserting the fresh yarn supply package into the canister, the support arm is pivoted at the connection point to move the yarn tensioner back into the operative position.

In yet another exemplary embodiment, the present disclosure comprises a method of loading a fresh yarn supply package into a canister for use in a direct-cabling textile machine.

Use of the terms "upstream" and "downstream" refer herein to relative locations (or movement) of elements or structure to other elements or structure along or adjacent the path of yarn travel. In other words, a first element or structure which is encountered along or adjacent the path of yarn travel before a second element or structure is considered to be "upstream" of the second element or structure, and the second element structure is considered to be "downstream" of the first. The term "housing" refers broadly herein to any open, closed, or partially open or partially closed structure.

In yet another exemplary embodiment, the disclosure comprises a canister-yarn tensioning assembly adapted for controlling tension in a running yarn drawn from a yarn supply package located within an open-top canister. The canister-yarn tensioning assembly includes a cylindrical adapter configured to reside at a mouth of the open-top canister. The adapter defines a package transfer space for inserting the yarn supply package through the adapter and into the canister. A repositionable cover is attached by a hinge assembly at a peripheral flange of the adapter, and is configured for multiplanar movement relative to the mouth of the open-top canister. An upstanding support arm has first and second ends, the first end being affixed to the cover. A yarn tensioner is carried by the second end of the support arm. The cover, support arm and yarn tensioner are movable as a single unit between an operative position within the package transfer space, wherein the yarn tensioner frictionally engages the running yarn drawn from the supply package, and a package-replacement position outside of the package transfer space.

Upon depleting the yarn supply package, the cover is pivoted in a first plane at the hinge assembly to lift away from the package transfer space and then swivelled in a second plane at the hinge assembly to locate adjacent an outside wall of the canister, thereby moving the cover, support arm and yarn tensioner as a unit from the operative position to the package-replacement position. In the package-replacement position, a fresh yarn supply package can be freely inserted through the package transfer space and into the canister. After inserting the fresh yarn supply package into the canister, the cover is swivelled and pivoted at the hinge assembly to return the yarn tensioner, support arm and cover back to the operative position.

In another exemplary embodiment, the disclosure comprises a canister-yarn tensioning assembly adapted for controlling tension in a running yarn drawn from a yarn supply package located within an open-top canister. The canister-yarn tensioning assembly includes a cylindrical adapter configured to reside at a mouth of the open-top canister. The adapter defines a package transfer space for inserting the yarn supply package through the adapter and into the canister. A yarn tensioner is attached by a hinge assembly at a peripheral flange of the adapter, and is configured for multiplanar movement between an operative position within the package transfer space, wherein the yarn tensioner frictionally engages the running yarn drawn from the supply package, and a package-replacement position outside of the package transfer space. Upon depleting the yarn supply package, the yarn tensioner is pivoted in a first plane at the hinge assembly to lift away from the package transfer space and then swivelled in a second plane at the hinge assembly to locate adjacent an outside wall of the canister, thereby moving the yarn tensioner from the operative position to the package-replacement position such that a fresh yarn supply package can be freely inserted through the package transfer space and into the canister. After inserting the fresh yarn supply package into the canister, the yarn tensioner is swivelled and pivoted at the hinge assembly to return to the operative position. In yet another exemplary embodiment, the disclosure comprises a method for replacing a yarn supply package located inside an open-top yarn canister of a textile machine. The textile machine utilizes a yarn tensioner adapted for controlling tension in a running yarn drawn from the yarn supply package. The method includes pivoting (repositioning) the yarn tensioner in first and second perpendicular planes upon depleting the yarn supply package, thereby moving the yarn tensioner from an operative position, wherein the yarn tensioner frictionally engages the running yarn drawn from the supply package, to a package-replacement position outside of a package transfer space. The package transfer space is configured for receiving a fresh yarn supply package into the canister. In the package-replacement position of the yarn tensioner, the fresh yarn supply package is inserted through the package transfer space and into the canister. After inserting the fresh yarn supply package into the canister, the yarn tensioner is again pivoted in first and second perpendicular planes to return the yarn tensioner to the operative position.

BRIEF DESCRIPTION OF THE DRAWINGS

Exemplary embodiments of the present disclosure will hereinafter be described in conjunction with the following drawing figures, wherein like numerals denote like elements, and wherein.

DESCRIPTION OF EXEMPLARY EMBODIMENTS AND BEST MODE

The present invention is described more fully hereinafter with reference to the accompanying drawings, in which one or more exemplary embodiments of the invention are shown. This invention may, however, be embodied in many different forms and should not be construed as limited to the embodiments set forth herein; rather, these embodiments are provided so that this disclosure will be operative, enabling, and complete. Accordingly, the particular arrangements disclosed are meant to be illustrative only and not limiting as to the scope of the invention, and any and all equivalents thereof. Moreover, many embodiments, such as adaptations, variations, modifications, and equivalent arrangements, will be implicitly disclosed by the embodiments described herein and fall within the scope of the present invention.

Although specific terms are employed herein, they are used in a generic and descriptive sense only and not for purposes of limitation. Unless otherwise expressly defined herein, such terms are intended to be given their broad ordinary and customary meaning not inconsistent with that applicable in the relevant industry and without restriction to any specific embodiment hereinafter described. As used herein, the article "a" is intended to include one or more items. Where only one item is intended, the term "one", "single", or similar language is used. When used herein to join a list of items, the term "or" denotes at least one of the items, but does not exclude a plurality of items of the list.

For exemplary methods or processes of the invention, the sequence and/or arrangement of steps described herein are illustrative and not restrictive. Accordingly, it should be understood that, although steps of various processes or methods may be shown and described as being in a sequence or temporal arrangement, the steps of any such processes or methods are not limited to being carried out in any particular sequence or arrangement, absent an indication otherwise. Indeed, the steps in such processes or methods generally may be carried out in various different sequences and arrangements while still falling within the scope of the present invention.

Additionally, any references to advantages, benefits, unexpected results, or operability of the present invention are not intended as an affirmation that the invention has been previously reduced to practice or that any testing has been performed. Likewise, unless stated otherwise, use of verbs in the past tense (present perfect or preterit) is not intended to indicate or imply that the invention has been previously reduced to practice or that any testing has been performed.

Figure 1:
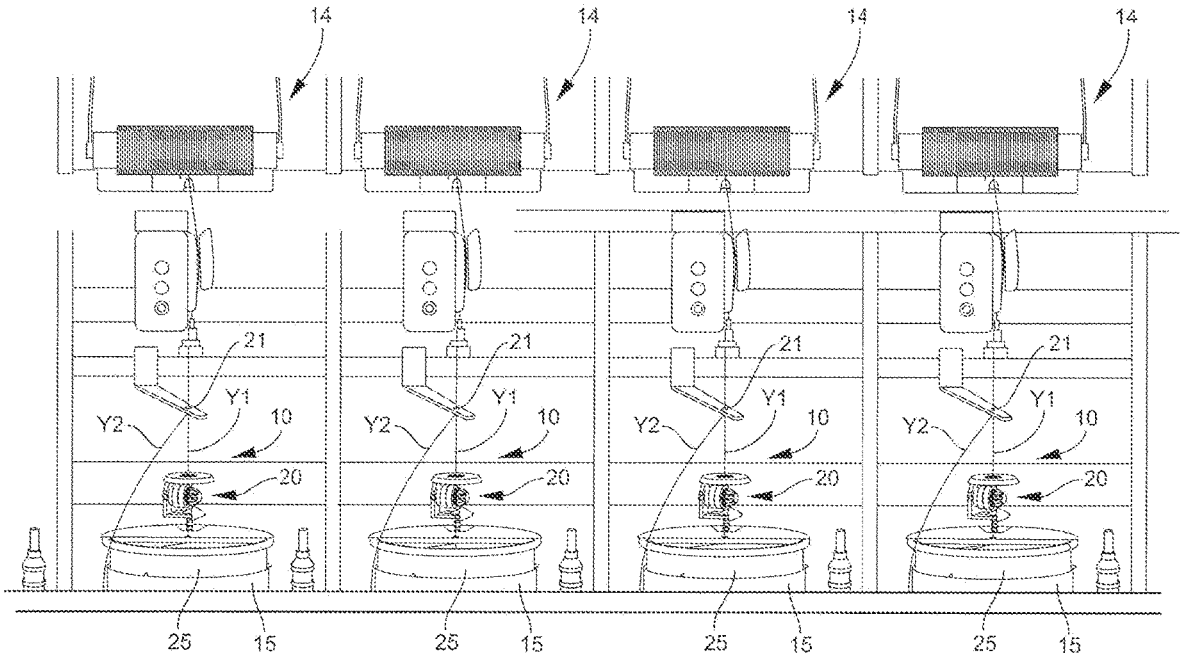
FIGS. 1 and 2 are views of a canister-yarn tensioning assembly according to one exemplary embodiment of the present disclosure.
Figure 2:
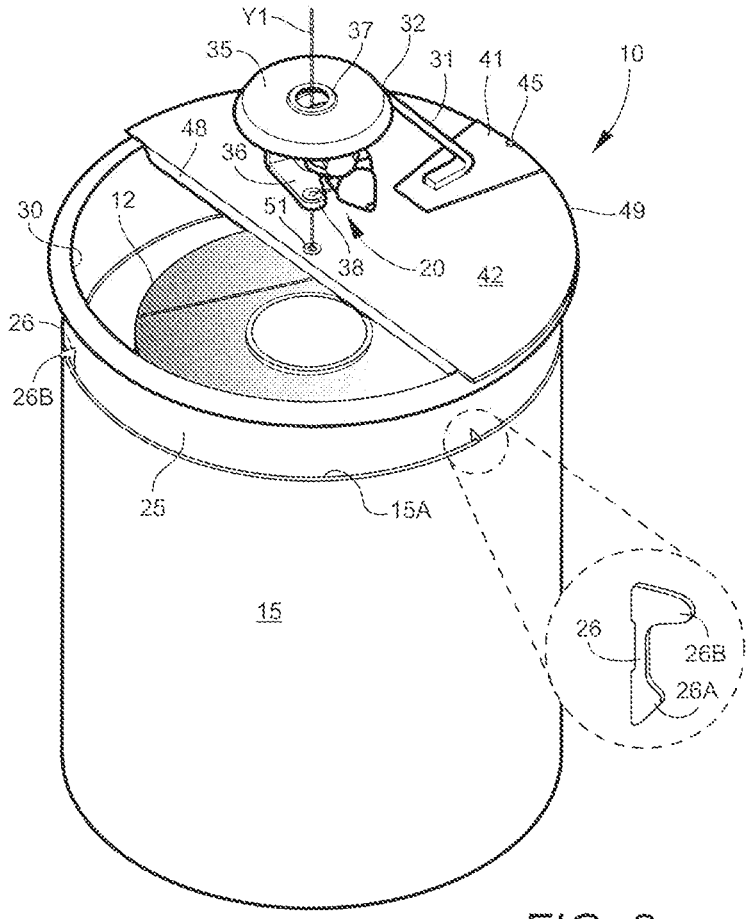

Referring now specifically to the drawings, a canister-yarn tensioning assembly according to one exemplary embodiment of the present disclosure is illustrated in FIGS. 1 and 2, and shown generally at broad reference numeral 10. The exemplary assembly resides between a yarn supply package 12 and a downstream textile machine—indicated at broad reference numeral 14. The supply package 12 is held within an open-top aluminum or stainless steel canister 15 or other suitable metal container. As described further below, the present assembly 10 incorporates a pivoted (or swing-out) yarn tensioner 20 configured and arranged to receive a running yarn Y1 pulled from the supply package 12 at an unwinding tension, and to adjust the unwinding tension such that the yarn Y1 exits the tensioner 20 at an adjusted downstream delivery tension. The exemplary yarn tensioner 20 may comprise a single yarn tensioning device or a combination pre-tensioner and adjustable main tensioner. Examples of Applicant's yarn pre-tensioner and adjustable main tensioner are disclosed in prior U.S. Pat. No. 10,407,272 and Publication No. US/2021/0163254. The complete disclosure of these publications is incorporated herein by reference.

The exemplary textile machine 14 may be a conventional direct-cabling machine used to form high-quality pile in the manufacture of rugs and carpets. In a direct-cabling machine, the supply package 12 is loaded into the cannister 15 and the yarn Y1 unwound and tensioned using a tensioning device, such as yarn tensioner 20. A second yarn Y2 drawn from a separate supply package (not shown) forms a revolving balloon around the cannister 15 and passes together with yarn Y1 through a downstream guide 21. At the balloon apex, both yarns Y1, Y2 meet and wrap around each other. At the meeting point, both yarns Y1, Y2 should have substantially the same tension in order to form a balanced composite yarn with no or limited residual torque and substantially equal lengths of component yarns. Each yarn Y1, Y2 may comprise a single-ply filament yarn.

The exemplary yarn tensioner 20 applies predetermined (e.g., calibrated) frictional resistance to the running yarn Y1, such that the downstream delivery tension is maintained at a generally uniform, constant and predictable level. When the yarn package 12 in the canister 15 is depleted, operation of the textile machine 14 position is temporarily suspended as a fresh package is added. Exemplary components and features of the present tensioning assembly 10 facilitate the process of removing the empty package tube and loading the fresh yarn package into the canister 15, thereby improving labor efficiencies and reducing machine downtime.

Referring to FIGS. 2-6, the present tensioning assembly 10 comprises a cylindrical metal (e.g., aluminum or stainless steel) adapter 25 configured to reside at an annular mouth 15A of the open-top canister 15. The adapter 25 partially nests inside the canister 15 and includes 3 or more equally spaced, outwardly projecting support pins 26 which function to place and hold the adapter 25 in position throughout operation of the textile machine 14. As best shown in FIG. 2, each pin 26 is secured to an outside cylindrical wall of the adapter 25 and has an integrally formed spacer 26A and outward projecting support 26B. The spacer 26A is designed to engage a cylindrical inside wall of the canister 15 while the pin support 26B sits atop the mouth 15A of canister 15. As discussed further below, the adapter 25 defines a selectively accessible package transfer space 30 sufficient to allow the yarn package 12 to be manually lowered through the adapter 25 and into the canister 15.

The exemplary yarn tensioner 20 of assembly 10 is carried by an upwardly-angled support arm 31 and tensioner bracket 32 configured to centrally locate the tensioner 20 above the yarn supply package 12 held in canister 15. The tensioner bracket 32 has a generally vertical leg 34 and integrally-formed horizontally-disposed upper and lower guide bars 35, 36—each bar defining a small annular yarn guide 37, 38. The support arm 31 is attached to the tensioner bracket 32 at one end and mounted at its opposite end to a small flat reinforcement plate 41. The reinforcement plate 41 is affixed to a larger generally semi-circular resilient flex cover 42. The exemplary flex cover 42 is fabricated of thin T302/304 stainless steel and is pivotably attached to a peripheral flange 25A of the adapter 25 at a single pivot connection point 45. See FIGS. 3, 4 and 6. The flex cover 42 is attached at the pivot connection point 45 using suitable hardware 46A, 46B shown in FIG. 6. In an exemplary embodiment, the yarn tensioner 20, support arm 31, tensioner bracket 32, reinforcement plate 41 and flex cover 42 are joined together as a single "integrated unit" and pivot as a single unit between an operative position within (or inside of) the package transfer space 30 and a package-replacement position outside of the package transfer space 30.

Figure 3:
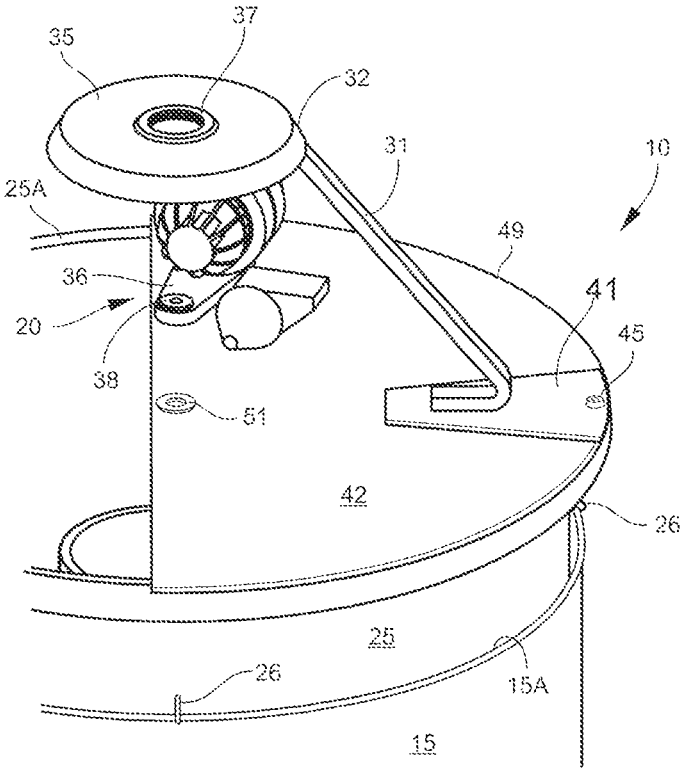
FIG. 3 is a fragmentary perspective view of the exemplary canister-yarn tensioning assembly.
Figure 4:
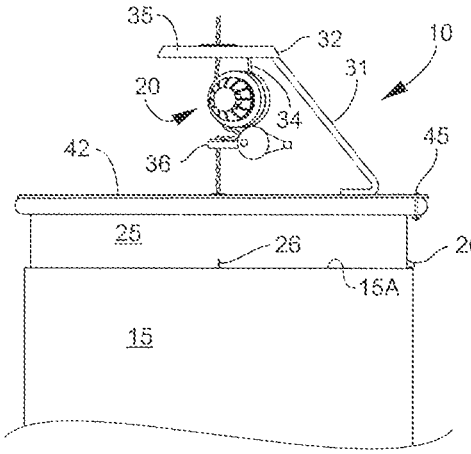
FIGS. 4 and 5 are side views of the exemplary canister-yarn tensioning assembly.
Figure 5:
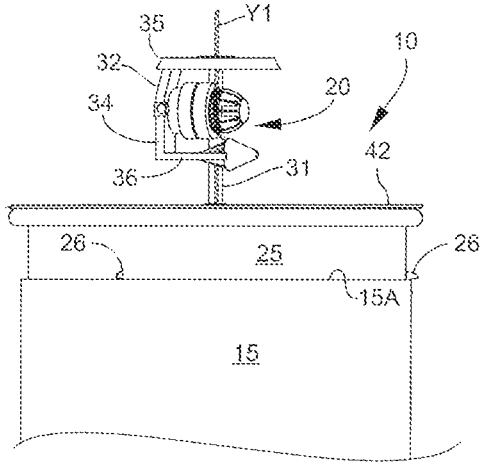
Figure 6:
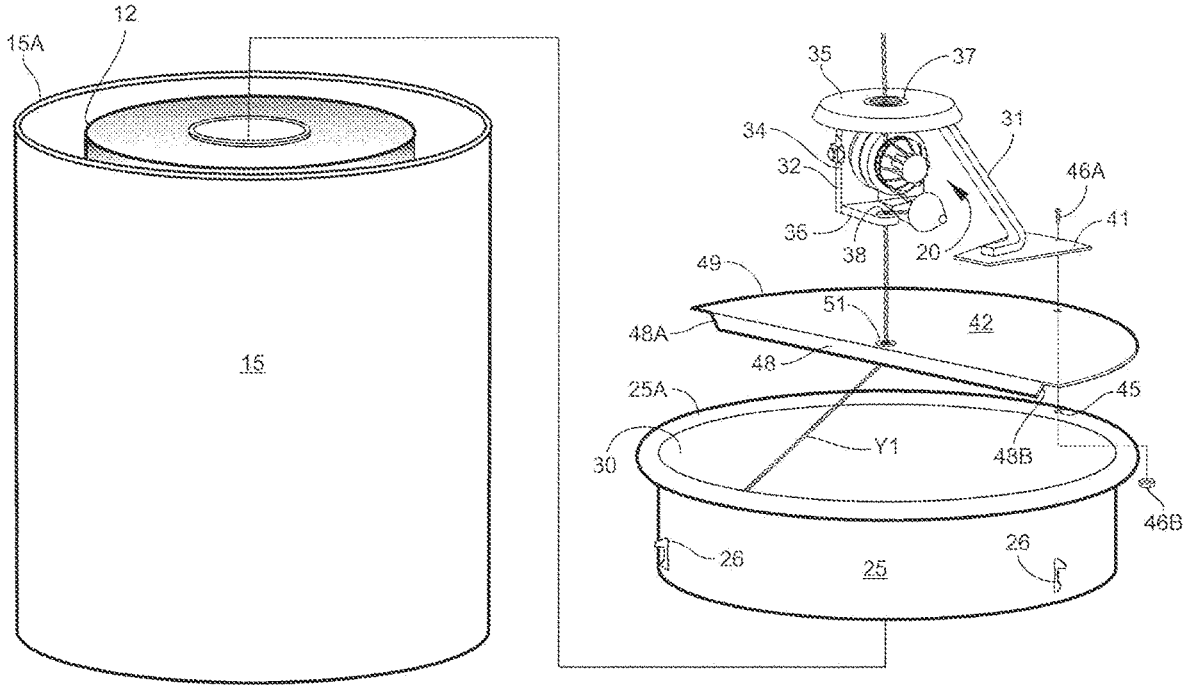
FIG. 6 is a perspective view of the exemplary canister-yarn tensioning assembly with various components exploded away.

As best shown in FIGS. 2, 3 and 6, the exemplary flex cover 42 has a downwardly turned lip 48 formed along a diameter line and an arcuate outside edge 49. In the operative position of yarn tensioner 20, the downwardly turned lip 48 of the flex cover 42 extends across the package transfer space 30 while the arcuate outside edge 49 aligns with the peripheral flange 25A of the adapter 25. Opposite ends 48A, 48B of the downwardly turned lip 48 may be slightly spaced from the arcuate edge 49 so that when manually pivoting the integrated unit including yarn tensioner 20 into the operative position, the flex cover 42 falls into place thereby precisely aligning the yarn tensioner 20 relative to the supply package 12. An annular yarn guide (hole) 51 may be formed in the flex cover 42 adjacent the lip 48. In the operative position, the yarn tensioner 20 frictionally engages the running yarn Y1 drawn from the supply package 12 during operation of the textile machine 14. The yarn tensioner 20 receives running yarn Y1 pulled from the supply package 12 at an unwinding tension, and adjusts the unwinding tension such that the yarn Y1 exits the tensioner 20 at an adjusted downstream delivery tension. The annular yarn guides 37, 38 formed with the tensioner bracket 32 on upstream and downstream sides of the yarn tensioner 20 vertically align with the yarn guide 51 of flex cover 42 and cooperate to control and direct the path of running yarn Y1 entering and exiting the tensioner 20.

Figure 7:
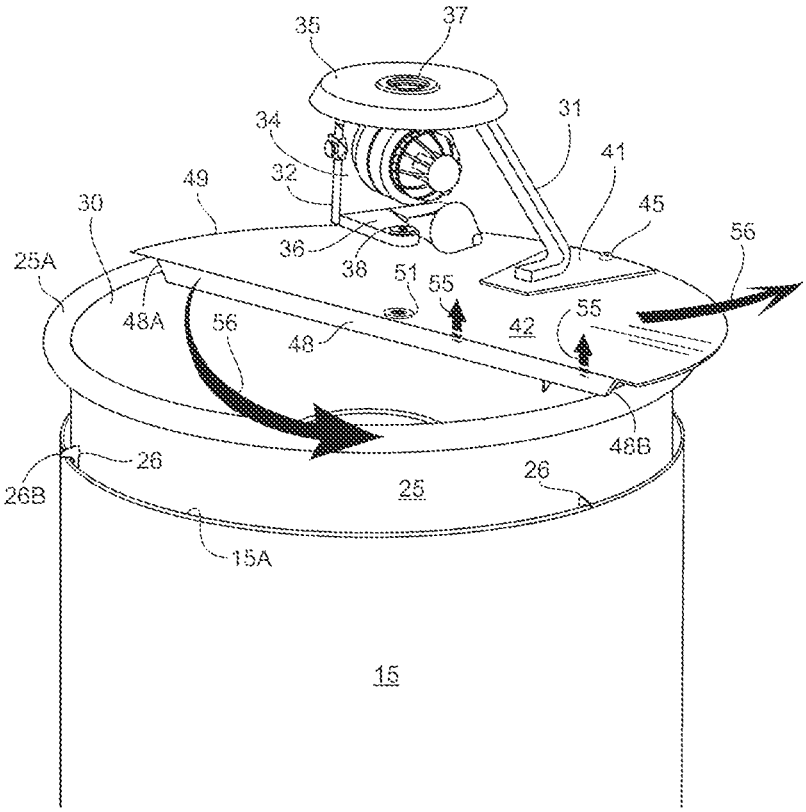
FIG. 7 demonstrates an exemplary process of simultaneously lifting and pivoting the flex cover to open a package transfer space defined by the assembly adapter.
Figure 8:
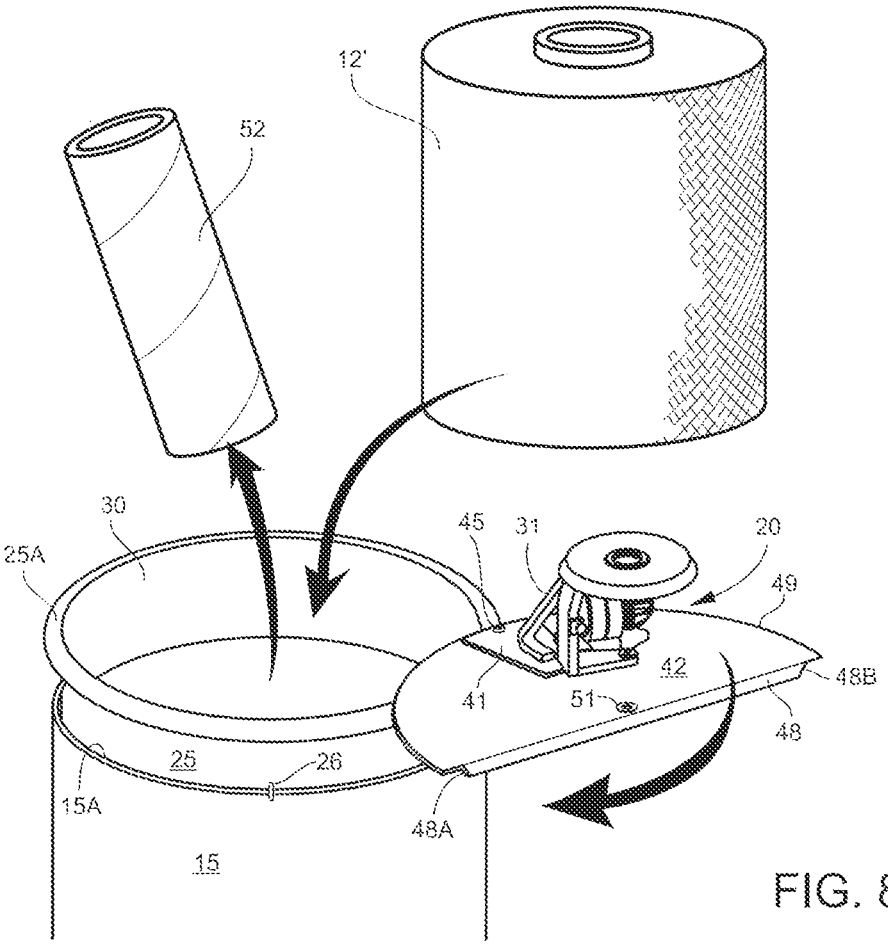
FIG. 8 shows the assembly in a package-replacement position whereby the empty package tube can be readily accessed, removed and discarded.

Referring to FIGS. 7 and 8, upon depleting the yarn supply package 12, operation of the textile machine 14 position is temporarily suspended while the empty package tube 52 is removed from the canister 15 and a fresh yarn package 12' manually loaded. The package transfer space 30 defined by adapter 25 is uncovered by simultaneously lifting and pivoting the flex cover 42, as demonstrated by arrows 55 and 56 in FIG. 7, so that the entire integrated unit including yarn tensioner 20 swings outwardly at the pivot connection point 45 into the package-replacement position shown in FIG. 8. In the package-replacement position, the empty package tube 52 can be readily accessed, removed and discarded. The fresh yarn package 12' is then quickly and conveniently placed into the canister 15 through the open transfer space 30 without any disassembly of parts. After loading the fresh yarn package 12', the entire integrated unit including yarn tensioner 20 is swung back into its original operative position over the yarn transfer space 30 of the adapter 25. In the operative position, the flex cover 42 also functions to manage airflow which might otherwise disrupt unwinding of yarn Y1 from the yarn package 12, 12'.

A further exemplary embodiment of the present yarn tensioning assembly 110 is disclosed in FIGS. 9-25. The exemplary tensioning assembly 110 operates in a textile factory, such factories simultaneously running numerous textile machines with associated like tensioning assemblies. Given the limited open floor space within the factory, each assembly 110 operates within a relatively confined area illustrated by the dashed notional box 111 in FIG. 9.

Referring to FIGS. 9-12, the exemplary tensioning assembly 110 resides between a yarn supply package 12 and a downstream textile machine (e.g., direct-cabling machine). The supply package 12 is located inside an open-top canister 115. Yarn tensioner 120 is configured and arranged to receive a running yarn Y pulled from the supply package 12 at an unwinding tension and to adjust the unwinding tension such that the yarn Y exits the tensioner 120 at an adjusted downstream delivery tension. Like tensioning assembly 10 described above, exemplary components and features of the assembly 110 facilitate the process of removing the empty package tube 12A and loading the fresh yarn package 12' into the canister 115. See FIG. 26. This process is completed as described below within the confined area of notional box 111.

The exemplary tensioning assembly 110 comprises a cylindrical metal adapter 125 configured to reside at an annular mouth 115A of the open-top canister 115. The adapter 125 partially nests inside the canister 115 and includes an annular exterior ridge (not shown) which functions to place and hold the adapter 125 in position throughout operation of the textile machine. The adapter 125 defines a selectively accessible package transfer space 130 sufficient to allow the yarn package 12 to be manually lowered through the adapter 125 and into the canister 115, and then subsequently exchanged with a fresh yarn package 12' once the original package 12 is depleted.

The exemplary yarn tensioner 120 is carried by an upwardly-angled support arm 131 and tensioner bracket 132 arranged to centrally locate the tensioner 120 above the yarn supply package 12 held in canister 115. The tensioner bracket 132 has a generally vertical leg 134 and integrally-formed horizontally-disposed upper and lower guide bars 135, 136—each bar defining a small annular yarn guide 137, 138. The support arm 131 is attached to the tensioner bracket 132 at one end and is mounted at its opposite end to a solid wall, generally semi-circular, repositionable cover 142. The repositionable cover 142 is adjustably attached by a hinge assembly 145 at a peripheral flange 125A of the adapter 125, and is configured for multiplanar pivot/swivel movement relative to the mouth 115A of the open-top canister 115. As described further below, the cover 142, support arm 131 and yarn tensioner 120 are movable as a single integrated unit between an operative position within the package transfer space 130, wherein the yarn tensioner 120 frictionally engages the running yarn Y drawn from the supply package 12, and a package-replacement position outside of the package transfer space 130.

Figure 9:
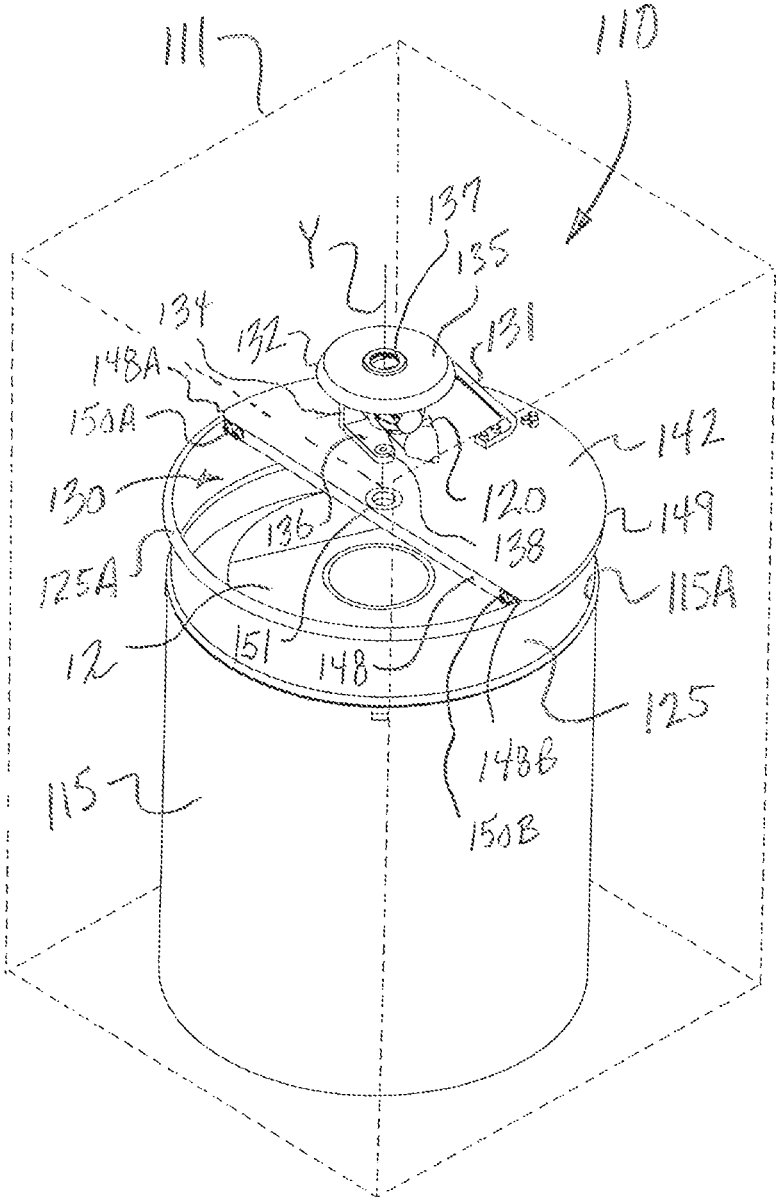
FIG. 9 is a perspective view a canister-yarn tensioning assembly according to another exemplary embodiment of the present disclosure.

As best shown in FIG. 9, the exemplary cover 142 has a downwardly turned lip 148 formed along a diameter line and an arcuate outside edge 149. In the operative position of yarn tensioner 120, the downwardly turned lip 148 extends across the package transfer space 130 while the arcuate outside edge 149 aligns with the peripheral flange 125A of the adapter 125. Opposite ends 148A, 148B of the downwardly turned lip 148 may be slightly spaced from the arcuate edge 149 so that when manually pivoting the integrate unit including yarn tensioner 120 into the operative position, the cover 142 falls into place thereby precisely aligning the yarn tensioner 120 relative to the supply package 12. Friction pads 150A, 150B may be located at opposite ends 148A, 148B of the downwardly turned lip 148 to releasably hold the cover 142 and yarn tensioner 120 in the operative position.

An annular yarn guide 151 may be formed in the exemplary cover 142 adjacent the downwardly-turned lip 148. In the operative position, the yarn tensioner 120 frictionally engages the running yarn Y drawn from the supply package 12 during operation of the textile machine. The yarn tensioner 120 receives running yarn Y pulled from the supply package 12 at an unwinding tension, and adjusts the unwinding tension such that the yarn Y exits the tensioner 120 at an adjusted downstream delivery tension. The annular yarn guides 137, 138 formed with the tensioner bracket 132 on upstream and downstream sides of the yarn tensioner 120 vertically align with the yarn guide 151 of cover 142 and cooperate to control and direct the path of running yarn Y entering and exiting the tensioner 120.

Figure 10:
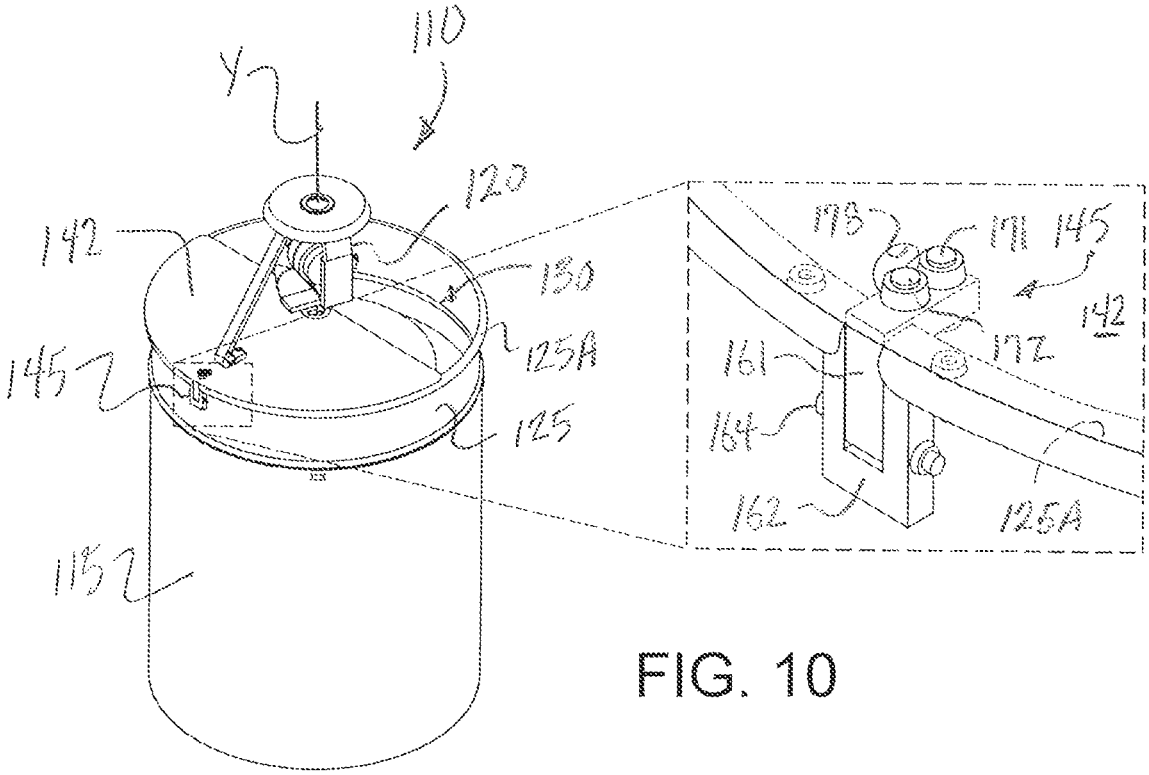
FIG. 10 is a further perspective view the canister-yarn tensioning assembly with the hinge assembly enlarged for clarity.
Figure 11:
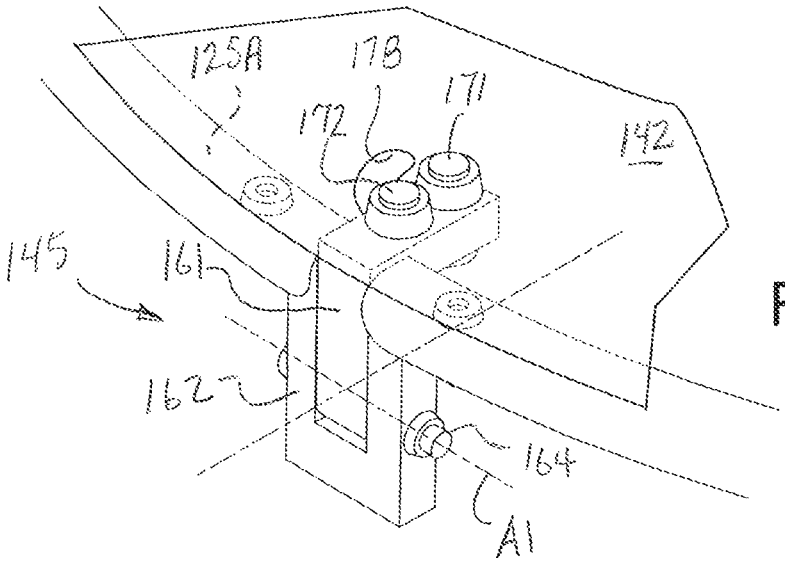
FIG. 11 is a fragmentary perspective view showing an enlarged portion of the assembly.
Figure 12:
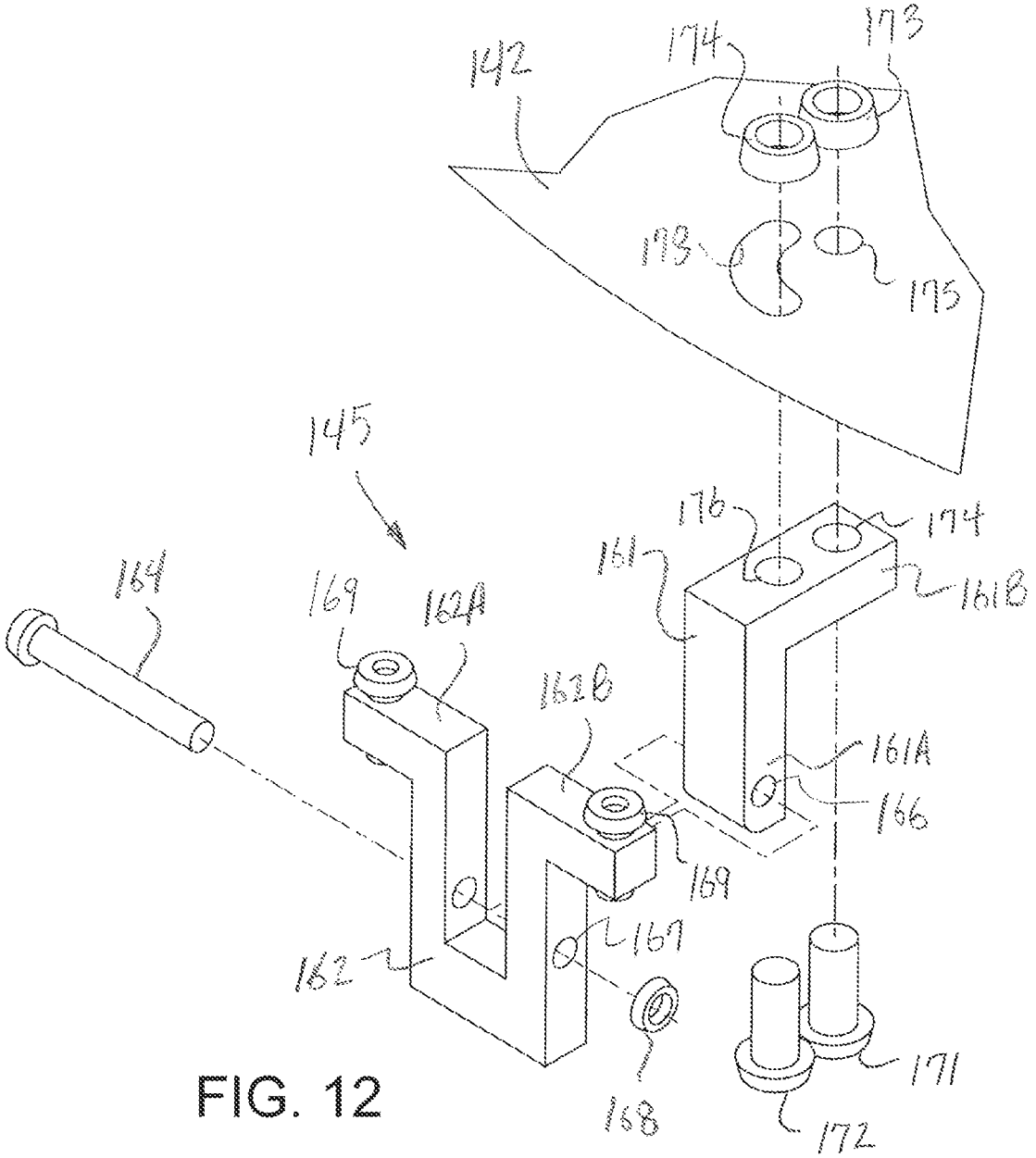
FIG. 12 is an enlarged exploded view of the exemplary hinge assembly.

When the yarn supply package 12 inside the canister 115 is depleted, the hinge assembly 145 enables pivoting movement of the cover 142, support arm 131 and yarn tensioner 120 as an integrated unit from the operative position within the package transfer space 130 to the package-replacement position outside of the package transfer space 130. As best shown in FIGS. 10, 11, and 12, the exemplary hinge assembly 145 comprises an inverted L-shaped leg 161 and a generally U-shaped cradle 162. The leg 161 and cradle 162 are pivotably connected together at a first end 161A of the leg 161 by a pivot pin 164 received through aligned fastener holes 166, 167. A distal end of the pivot pin 164 mates with a complementary nut 168. The cradle 162 is attached at shoulders 162A, 162B to the underside of the peripheral flange 125A by fasteners 169. A second end 161B of the leg 161 is attached to the cover 142 by first and second bolts 171, 172 and complementary nuts 173, 174. The first bolt 171 extends through a fastener hole 174 in the leg 161 and through an aligned fastener hole 175 in the cover 142. The second bolt 172 extends through a second fastener hole 176 in the leg 161 and through an arcuate (swivel) cutout 178 formed in the cover 142. As described further below, the exemplary hinge assembly 145 enables multiplanar pivoting/swivel movement of the cover 142 relative to the mouth 115A of the open-top canister 115.

FIGS. 13-25 demonstrate pivoting and swivel movement of the cover 142 from the operative position of yarn tensioner 120 to the package-replacement position. Upon depleting the yarn supply package 12, operation of the textile machine is temporarily suspended to initiate the process for replacing the empty package tube 12A with a fresh yarn package 12'. See FIG. 26.

Figure 13:
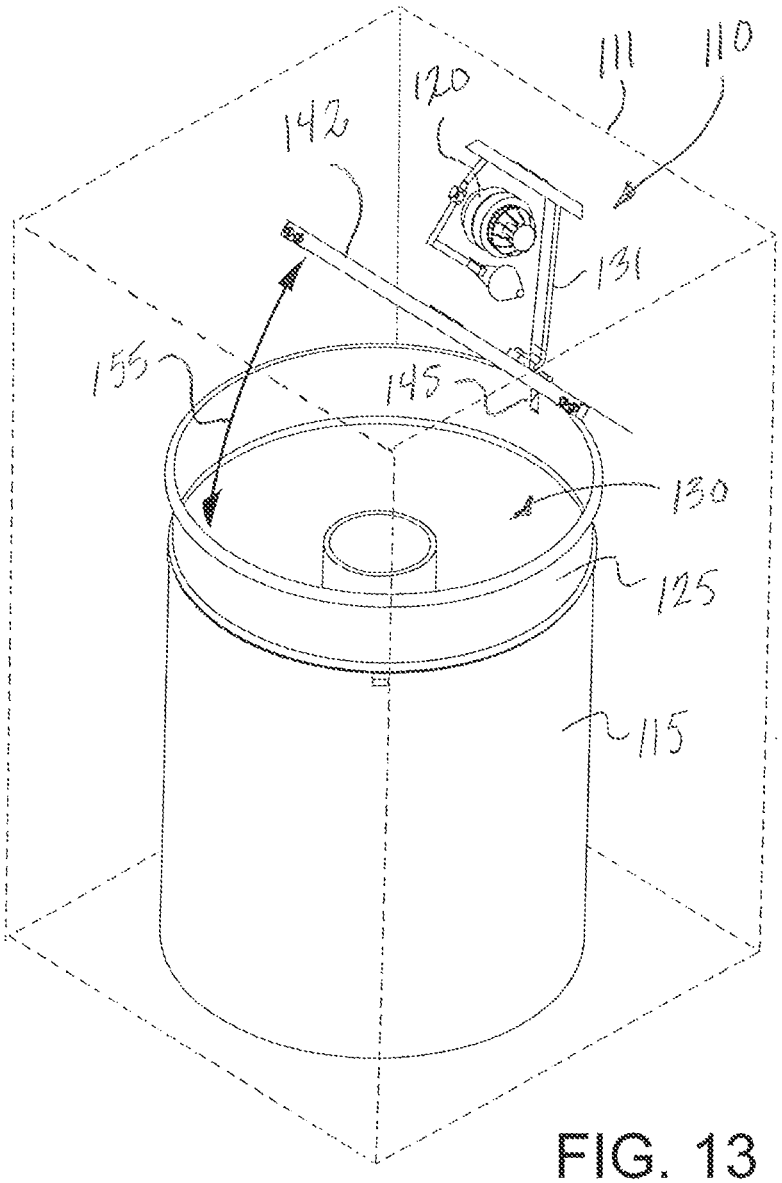
FIGS. 13-16 demonstrate pivoting of the repositionable cover in a first plane of movement from an operative position of the yarn tensioner to an intermediate position substantially 45 degrees above an open top of the canister.
Figure 14:
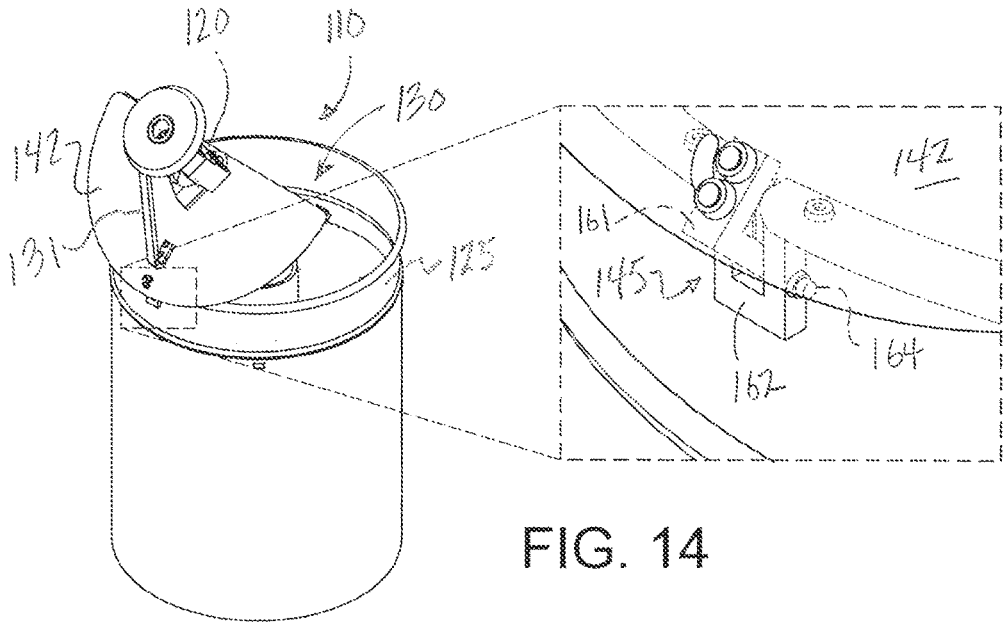
Figure 15:
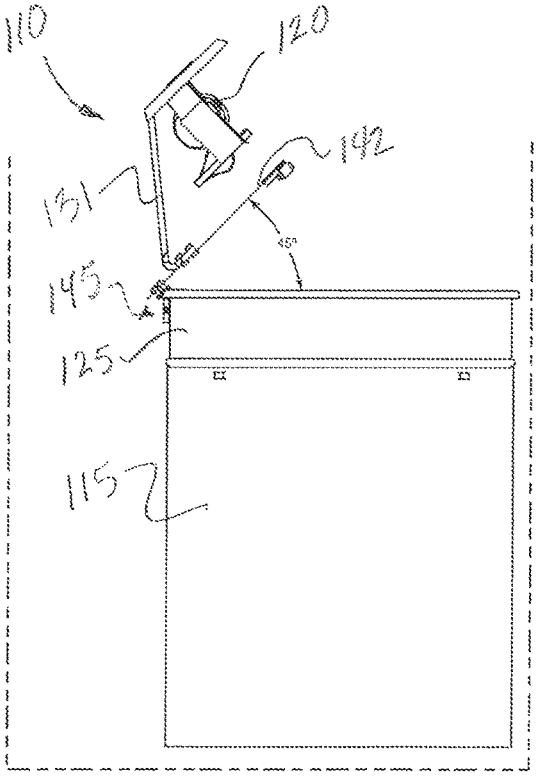
Figure 16:
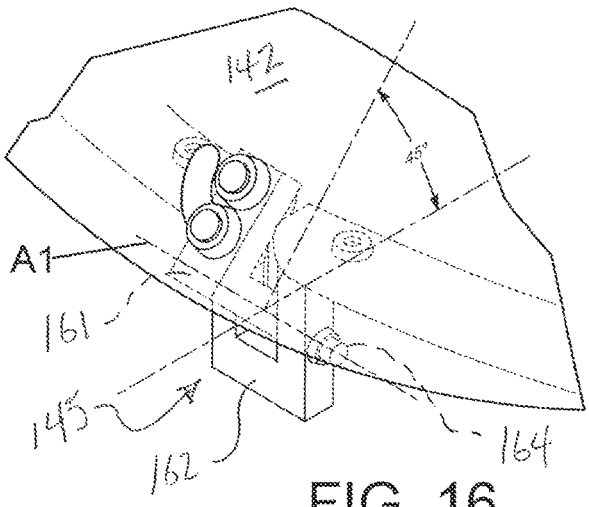

Referring to FIGS. 13-16, the package transfer space 130 defined by adapter 125 is uncovered by simultaneously lifting and pivoting the cover 142, as demonstrated by arrow 155 in FIG. 13, so that the entire integrated unit including yarn tensioner 120 pivots at the hinge assembly 145 in a first plane of movement. Remaining within the confined space defined by notional box 111, the cover 142 is pivoted approximately 45 degrees relative to the open top of the adapter 125. The leg 161 of hinge assembly 145 pivots on pin 164 carried by the cradle 162—the pin 164 defining a first pivot axis A1 shown in FIG. 16.

Figure 17:
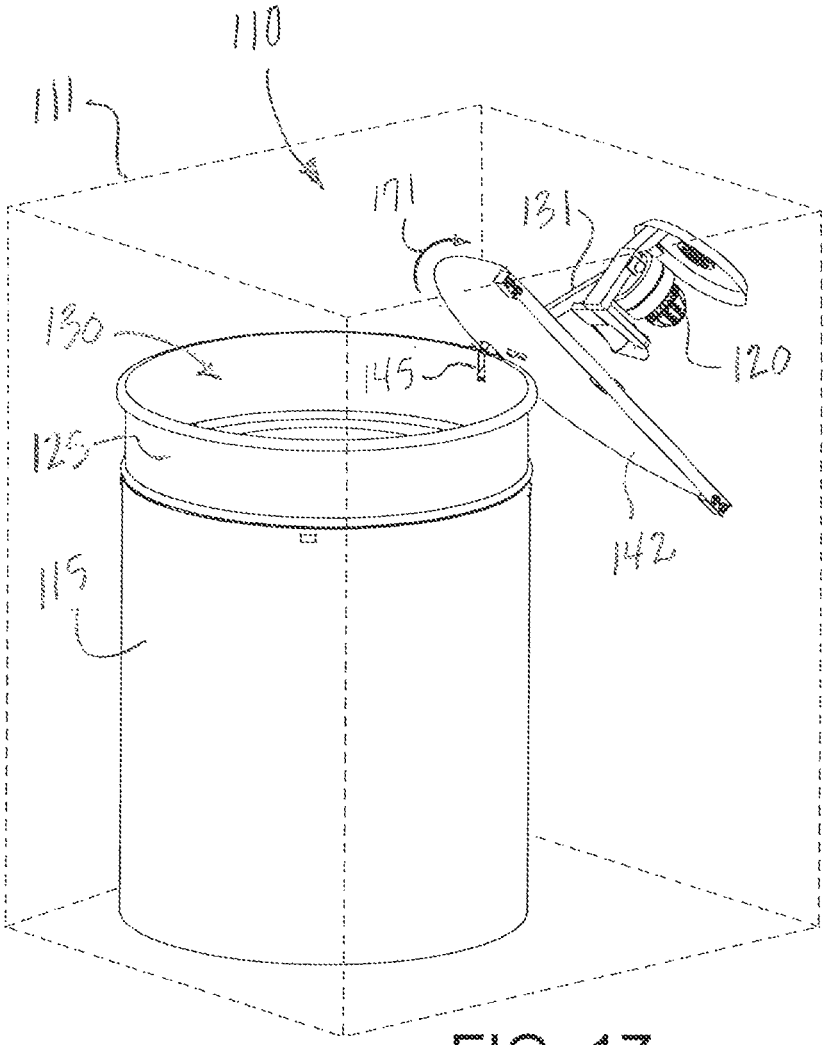
FIGS. 17-20 demonstrate swivelling of the repositionable cover in a second plane of movement.
Figure 18:
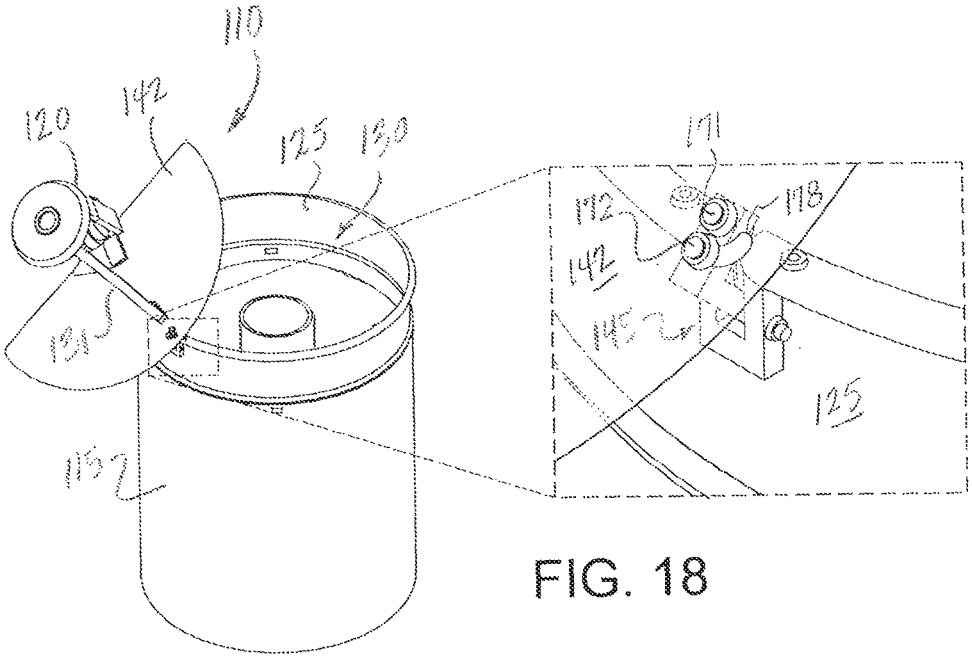
Figure 19:
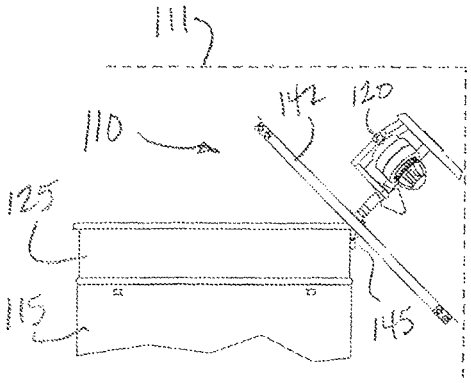
Figure 20:
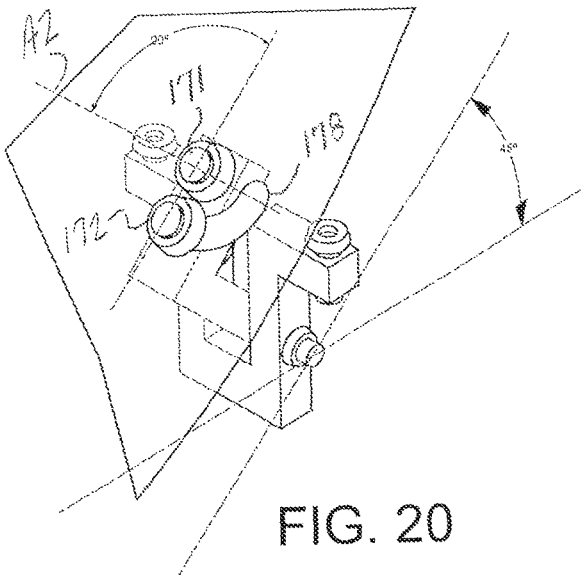
Figure 21:
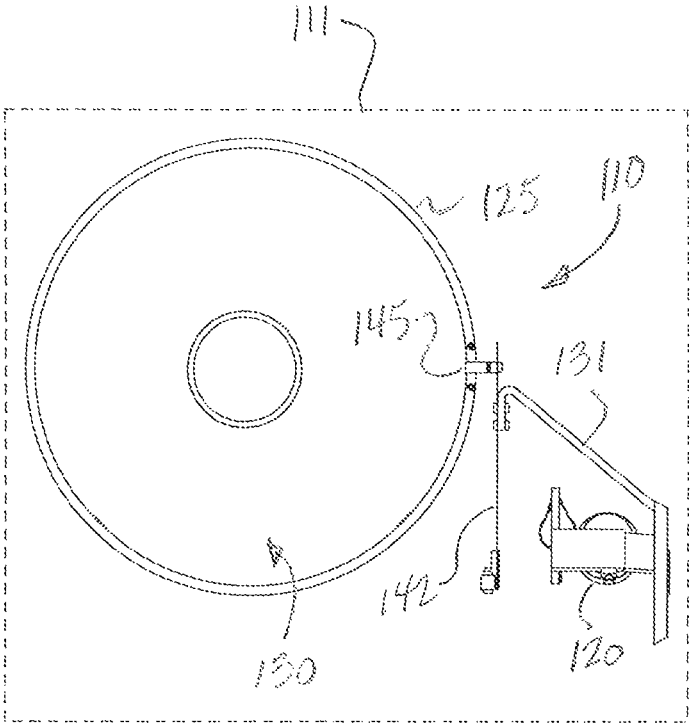
FIGS. 21-25 demonstrate further pivoting of the repositionable cover in the first plane of movement from the intermediate position to a package-replacement position of the yarn tensioner.
Figure 22:
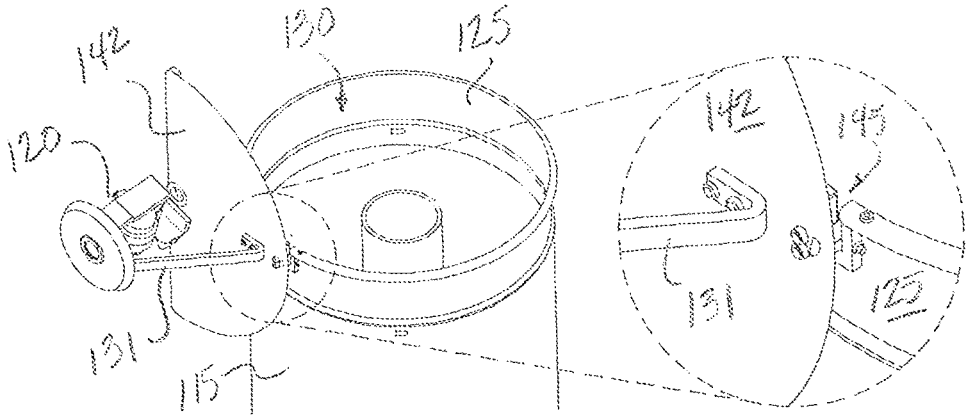
Figure 23:
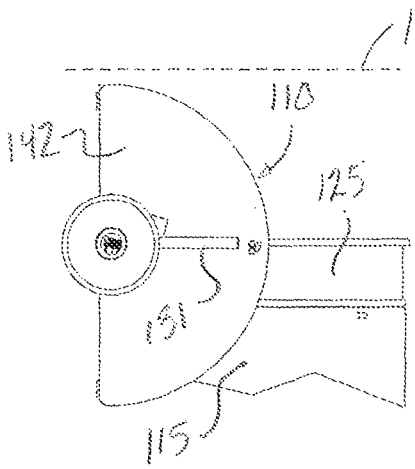
Figure 24:
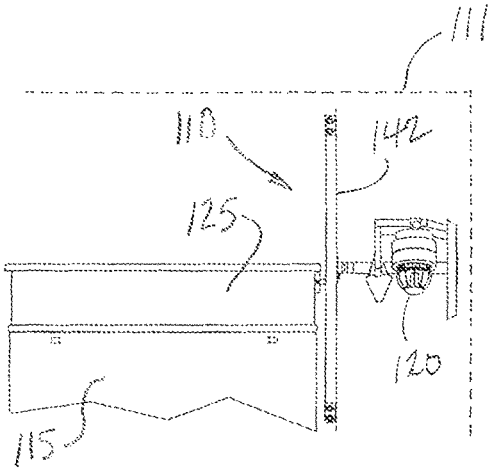
Figure 25:
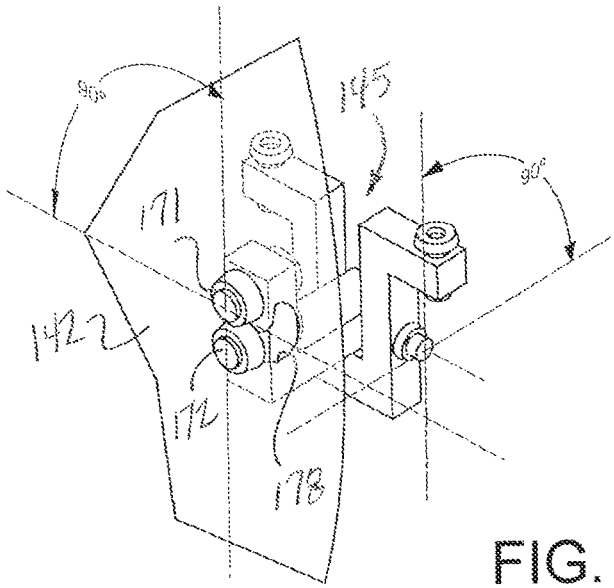

From the 45-degree pivoted position of FIG. 13, the cover 142 is swivelled 90 degrees in the direction of arrow 171 in FIG. 17, and as demonstrated further in FIGS. 18-20. The second bolt 172 attaching the leg 161 of hinge assembly 145 to the cover 142 extends through the arcuate cutout 178, while the first bolt 171 defines a second pivot axis A2 (FIG. 20) perpendicular to the first axis A1. The arcuate cutout 178 allows the cover 142 to swivel substantially 90 degrees in a second plane of movement from its position shown in FIGS. 13-16 to the position shown in FIGS. 17-20.

From the 45-degree pivoted and swivelled position of FIG. 17, the cover 142 is further pivoted at hinge assembly 145 another 45 degrees within the notional box 111 to reside adjacent an outside wall of the canister 115, as shown in FIGS. 21-25. In this position, the entire integrated unit (cover 142, support arm 131 and yarn tensioner 120) locates in the package-replacement position.

Figure 26:
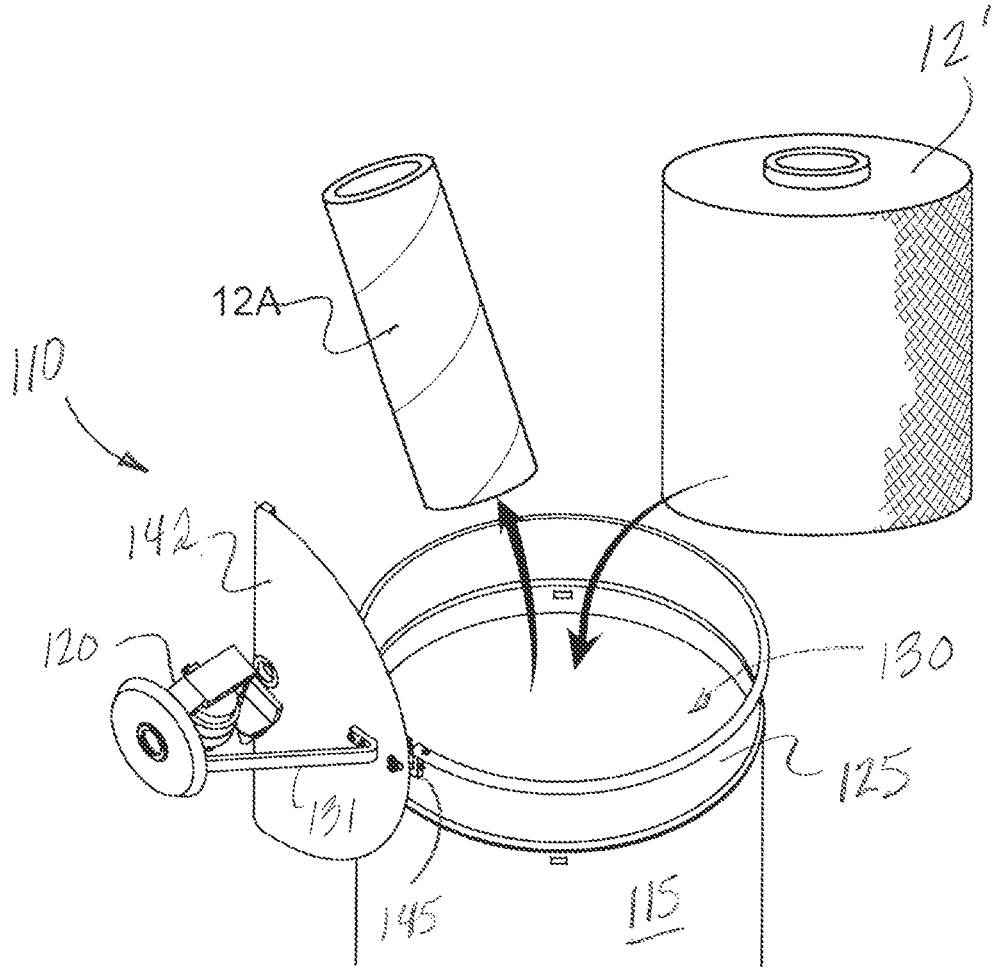
FIG. 26 demonstrates replacement of the empty package tube with a fresh supply yarn package with the repositionable cover in the package-replacement position.

As demonstrated in FIG. 26, in the package-replacement position the empty package tube 12A can be readily accessed, removed and discarded. The fresh yarn package 12' is then quickly and conveniently placed into the canister 115 through the open transfer space 130 without any disassembly of parts. After loading the fresh yarn package 12', the entire integrated unit including yarn tensioner 120 is pivoted/swivelled back into its original operative position over the yarn transfer space 130 of the adapter 125.

In further alternative embodiments of the present disclosure, the exemplary tensioning assembly may omit the stainless steel flex cover and the support arm carrying the yarn tensioner may be pivotably attached directly to the annular flange of the adapter; or in the absence of adapter, directly to the top annular edge of the canister. In still further exemplary embodiments, the support arm carrying the yarn tensioner may pivot at the connection point generally perpendicular to a plane of the package transfer space—as opposed to the side-to-side "swing-out" movement of the integrated unit described above.

For the purposes of describing and defining the present invention it is noted that the use of relative terms, such as "substantially", "generally", "approximately", and the like, are utilized herein to represent an inherent degree of uncertainty that may be attributed to any quantitative comparison, value, measurement, or other representation. These terms are also utilized herein to represent the degree by which a quantitative representation may vary from a stated reference without resulting in a change in the basic function of the subject matter at issue.

Exemplary embodiments of the present invention are described above. No element, act, or instruction used in this description should be construed as important, necessary, critical, or essential to the invention unless explicitly described as such. Although only a few of the exemplary embodiments have been described in detail herein, those skilled in the art will readily appreciate that many modifications are possible in these exemplary embodiments without materially departing from the novel teachings and advantages of this invention. Accordingly, all such modifications are intended to be included within the scope of this invention as defined in the appended claims.

In the claims, any means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. Unless the exact language "means for" (performing a particular function or step) is recited in the claims, a construction under 35 U.S.C. § 112 (f) [or 6th paragraph/pre-AIA] is not intended. Additionally, it is not intended that the scope of patent protection afforded the present invention be defined by reading into any claim a limitation found herein that does not explicitly appear in the claim itself.

What is claimed:

1. A canister-yarn tensioning assembly adapted for controlling tension in a running yarn drawn from a yarn supply package located within an open-top canister, said canister-yarn tensioning assembly comprising:

a cylindrical adapter configured to reside at a mouth of the open-top canister, and defining a package transfer space for inserting the yarn supply package through the adapter and into the canister;

a repositionable cover attached by a hinge assembly at a peripheral flange of said adapter, and configured for multiplanar movement relative to the mouth of the open-top canister;

an upstanding support arm having first and second ends, the first end being affixed to said cover;

a yarn tensioner carried by the second end of said support arm, and wherein said cover, support arm and yarn tensioner are movable as a unit between an operative position within the package transfer space, wherein said yarn tensioner frictionally engages the running yarn drawn from the supply package, and a package-replacement position outside of the package transfer space, whereby:

(i) upon depleting the yarn supply package, said cover is pivoted in a first plane at said hinge assembly to lift away from the package transfer space and then swivelled in a second plane at said hinge assembly to locate adjacent an outside wall of the canister, thereby moving said cover, support arm and yarn tensioner as a unit from the operative position to the package-replacement position such that a fresh yarn supply package can be freely inserted through the package transfer space and into the canister; and (ii) after inserting the fresh yarn supply package into the canister, said cover is swivelled and pivoted at said hinge assembly to return said yarn tensioner, support arm and cover back to the operative position.

2. The canister-yarn tensioning assembly according to claim 1, wherein said cover is fabricated of stainless steel.

3. The canister-yarn tensioning assembly according to claim 1, wherein said yarn tensioner comprises at least one of a pre-tensioner and an adjustable main tensioner.

4. The canister-yarn tensioning assembly according to claim 1, and comprising a tensioner bracket attached to said support arm and comprising spaced apart first and second yarn guides located at upstream and downstream sides of said yarn tensioner.

5. The canister-yarn tensioning assembly according to claim 1, wherein said cover has a generally semi-circular shape.

6. The canister-yarn tensioning assembly according to claim 5, wherein said cover comprises a downwardly angled lip formed along a diameter line of said cover and configured to extend across the package transfer space when said yarn tensioner resides in the operative position.

7. The canister-yarn tensioning assembly according to claim 6, wherein said cover comprises an arcuate outside edge configured to align with the peripheral flange of said adapter when said yarn tensioner resides in the operative position.

8. The canister-yarn tensioning assembly according to claim 7, wherein said support arm angles inwardly from the arcuate edge of said cover towards the diameter line of said cover.

9. A canister-yarn tensioning assembly adapted for controlling tension in a running yarn drawn from a yarn supply package located within an open-top canister, said canister-yarn tensioning assembly comprising:

a cylindrical adapter configured to reside at a mouth of the open-top canister, and defining a package transfer space for inserting the yarn supply package through the adapter and into the canister;

a yarn tensioner attached by a hinge assembly at a peripheral flange of said adapter, and configured for multiplanar movement between an operative position within the package transfer space, wherein said yarn tensioner frictionally engages the running yarn drawn from the supply package, and a package-replacement position outside of the package transfer space, whereby:

(i) upon depleting the yarn supply package, said yarn tensioner is pivoted in a first plane at said hinge assembly to lift away from the package transfer space and then swivelled in a second plane at said hinge assembly to locate adjacent an outside wall of the canister, thereby moving said yarn tensioner from the operative position to the package-replacement position such that a fresh yarn supply package can be freely inserted through the package transfer space and into the canister; and (ii) after inserting the fresh yarn supply package into the canister, said yarn tensioner is swivelled and pivoted at said hinge assembly to return to the operative position.

* * * * *